US010928171B2

(12) United States Patent
De Bonis

(10) Patent No.: US 10,928,171 B2
(45) Date of Patent: Feb. 23, 2021

(54) HYBRID CAST METALLIC POLYMER PENETRATOR PROJECTILE

(71) Applicant: U.S. Army Research Laboratory, Adelphi, MD (US)

(72) Inventor: Daniel M. De Bonis, Stewartstown, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/248,898

(22) Filed: Jan. 16, 2019

(65) Prior Publication Data

US 2020/0225012 A1 Jul. 16, 2020

(51) Int. Cl.

| | |
|---|---|
| ***F42B 12/76*** | (2006.01) |
| ***F42B 12/74*** | (2006.01) |
| ***F42B 33/02*** | (2006.01) |
| ***F42B 12/38*** | (2006.01) |
| ***F42B 12/36*** | (2006.01) |

(52) U.S. Cl.

CPC ..... *F42B 12/76* (2013.01); *F42B 12/367* (2013.01); *F42B 12/38* (2013.01); *F42B 12/74* (2013.01); *F42B 33/0242* (2013.01)

(58) Field of Classification Search

CPC ..... F42B 12/76; F42B 12/367; F42B 12/38; F42B 12/00; F42B 12/04; F42B 12/06; F42B 12/08; F42B 12/34; F42B 12/365; F42B 12/72; F42B 12/745; F42B 12/74; F42B 33/0242

USPC ..... 102/506, 458, 513

See application file for complete search history.

(56) References Cited

U.S. PATENT DOCUMENTS

| | | | | |
|---|---|---|---|---|
| 5,763,819 | A | 6/1998 | Huffman | |
| 6,048,379 | A | 4/2000 | Bray et al. | |
| 6,230,630 | B1 | 5/2001 | Gibson et al. | |
| 7,204,191 | B2 | 4/2007 | Wiley et al. | |
| 7,520,224 | B2 * | 4/2009 | Taylor | F42B 12/06 102/473 |
| 8,393,273 | B2 * | 3/2013 | Weeks | F42B 12/74 102/506 |
| 8,397,641 | B1 * | 3/2013 | Jackson | F42B 12/74 102/517 |
| 9,982,981 | B2 * | 5/2018 | Nielson | F42B 12/06 |
| 10,436,557 | B2 * | 10/2019 | Stakes | F42B 12/78 |
| 10,527,393 | B1 * | 1/2020 | Sapp | F42B 12/06 |
| 10,551,154 | B2 * | 2/2020 | Peterson | F42B 10/22 |
| 2003/0027005 | A1 | 2/2003 | Elliott | |
| 2004/0129165 | A1 | 7/2004 | Cesaroni | |
| 2007/0017409 | A1 * | 1/2007 | Mansfield | F42B 12/08 102/518 |
| 2009/0293754 | A1 * | 12/2009 | Riess | F42B 12/74 102/506 |
| 2017/0089673 | A1 * | 3/2017 | Burrow | F42B 12/32 |

(Continued)

*Primary Examiner* — John Cooper

(74) *Attorney, Agent, or Firm* — Alan Kalb

(57) ABSTRACT

Embodiments of a projectile are provided herein. In some embodiments, a projectile includes a body made of a cast polymer composite material comprising a thermoset resin and a powdered steel. In some embodiments, a projectile includes: a body made of a cast polymer composite material comprising a thermoset resin and a powdered metal; a metal core embedded in the body having a front portion that tapers radially inward to define a front end of the projectile; and a casing assembly coupled to the body.

1 Claim, 5 Drawing Sheets

(56) References Cited

U.S. PATENT DOCUMENTS

| | | | | |
|---|---|---|---|---|
| 2017/0176156 | A1* | 6/2017 | Rubin | F42B 12/60 |
| 2019/0265010 | A1* | 8/2019 | Greene | F42B 12/745 |

* cited by examiner

HYBRID CAST METALLIC POLYMER PENETRATOR PROJECTILE

GOVERNMENT RIGHTS IN THIS DISCLOSURE

Governmental Interest—The disclosure described herein may be manufactured, used and licensed by or for the U.S. Government. Research underlying embodiments of the present disclosure was developed by the U.S. Army Research Laboratory (ARL).

FIELD

Embodiments of the present disclosure generally relate to projectiles, and more specifically, cast polymer projectiles.

BACKGROUND

Ballistic projectiles have been used for hundreds of years starting with crude ball projectiles eventually becoming conical in shape to work better with rifled barrels. The spritzer projectile most commonly used for rifle bullet designs was developed for greater aerodynamics in the late $19^{th}$ and early $20^{th}$ century. Variations in diameter, weight and aerodynamics largely dominate past advances. Bullets with specialized applications like armor piercing were developed and trended to match improvements in armor design. All ballistic designs, be they tracers or penetrators had to work with a combination of metallic components requiring sophisticated dedicated factories for production.

Ballistic projectiles are generally exclusively metallic in composition. These projectiles are fabricated with semi-precious metals like copper which increases their cost considerably. In addition, the main component of projectiles is their lead content. Lead is becoming more of an issue environmentally and its supply is limited domestically with increasing dependence on foreign suppliers. Also, the metallic nature of the projectiles also makes it difficult to embed items within the projectiles.

Accordingly, the inventors have provided an improved projectile and methods of manufacturing an improved projectile.

SUMMARY

Embodiments of a projectile are provided herein. In some embodiments, a projectile includes a body made of a cast polymer composite material comprising a thermoset resin and a powdered steel.

In some embodiments, a method for manufacturing a projectile includes flowing a polymer composite comprising mixture of a thermoset resin and a powdered metal into a casting mold configured to form a predetermined caliber projectile, inserting the casting mold into a pressure vessel, and curing the polymer composite at a predetermined temperature and a predetermined pressure for a predetermined duration.

In some embodiments, a method for manufacturing a polymer composite projectile includes placing at least one of a metal core, an electronic payload, or a combustible material into a mold configured to form a predetermined caliber projectile, flowing a polymer composite comprising a thermoset resin and a powdered metal into the mold, inserting the mold into a pressure vessel, pressurizing the pressure vessel to a predetermined pressure, and curing the polymer composite at a predetermined temperature for a predetermined duration.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only some embodiments of the disclosure and are therefore not to be considered limiting of scope, for the disclosure may admit to other equally effective embodiments.

Figure 1A:
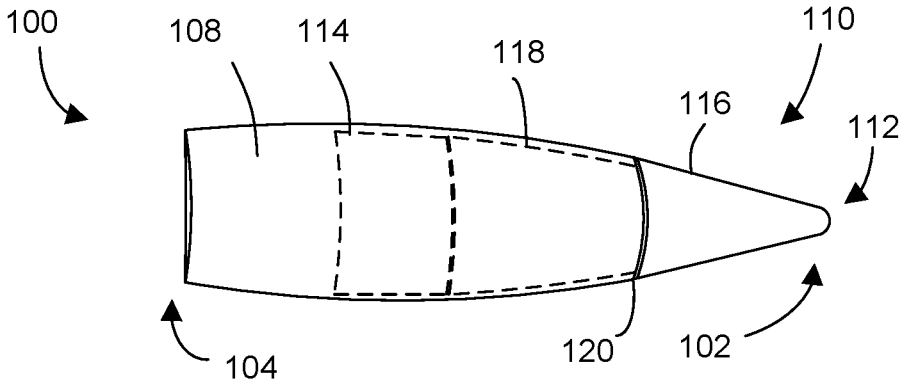
FIG. 1A depicts a projectile made of a poly composite material and having a steel penetrator and a pellet in accordance with some embodiments of the present disclosure.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION

Embodiments of an improved projectile are provided herein. Millions of conventional small arms ballistic projectiles are manufactured every year for military and civilian defense applications. Projectiles which are designed for armor piercing/enhanced penetration of hardened targets such as ballistic armor, metallic barriers, and building materials incorporate a penetrator that is hardened into the core material which does not deform upon impact. This is typically done using penetrator materials such as tungsten alloys, hardened steel alloys, beryllium copper and other such hardened materials. The fabrication of these projectiles requires the bullet be formed in several steps in which all the components must be precisely integrated and formed to retain a high degree of ballistic performance and accuracy. This disclosure identifies a means to produce projectiles using simple and cost effective materials with penetrator properties coupled with enhanced fragmentation. This provides a projectile that can penetrate armor at close distances coupled with secondary fragmentation damage that is not available with existing projectiles. It's design also allows a much lighter projectile to attain very high velocities but due to its lower mass, rapidly reducing its energy over distance significantly reducing unintended penetration of targets outside of the intended engagement area. This would be significant in areas of urban combat and similar limited distance engagements where collateral damage is not acceptable.

This disclosure advantageously describes how to produce projectiles in a manner allowing implantation of various features such as penetrators, fragmentation structures, and micro-electronics (that are not possible in the standard conventional metallic fabrication). This allows projectiles to contain features which can enhance their lethality and or better functionalize their damage properties between penetration and fragmentation. Also, in some embodiments, this disclosure advantageously describes a method of fabricating projectiles that are free of copper and lead, which are materials that can be in limited supply, for example, during war. The improved projectiles described herein use polymer combined with a wide variety of very inexpensive and widely available powdered metals.

The improved projectile and method of making an improved projectile includes using a relatively dense metal powder typical of metal compaction fabrication combined with a two part thermosetting resin used for precision replication of the projectile shape. In some embodiments, the metal powder comprises powdered steel, powdered brass, powdered copper, powdered bismuth, powdered copper, powdered tungsten, or the like. In some embodiments, the thermoset resin includes a polyurethane resin, such as the ULTRACLEAR™ 480 series and the ULTRAALLOY™ 200 series available from Hapco, Inc. of Hanover, Mass., Fibre Glast 3475 available from Fibre Glast Developments Corp. of Brookville, Ohio, and Protocast 80R available from Industrial Polymers Corp. of Houston, Tex. In some embodiments, the thermoset resin includes an epoxy resin, such as EPDXACAST™ 670 available from Smooth-On, Inc. of Macungie, Pa.

The metal powder and resin are combined in a ratio that maximizes the density of the final cured projectile but allows for flow of the powdered metal and resin mixture, resulting in a substantially void free projectile. In some embodiments, the ratio is 1.5-5 parts powdered metal to 1 part resin. In some embodiments, the density of the powdered metal and resin mixture is about 2 grams per cubic centimeter to about 3.7 grams per cubic centimeter. The projectile can have an outer diameter configured to fit in any firearm. In some embodiments, the outer diameter of the projectile is about 7.0 mm to about 9.0 mm.

This disclosure also allows the implantation of structural features such as a hardened penetrator, a stiffing rod, and a fragmenting compressed metal pellet into the powdered metal and resin mixture to fabricate novel ballistic projectiles for small arms. This disclosure allows the incorporation of both a penetrator and or a fragmenting component into a highly precise formed projectile. The projectile utilizes very simple manufacturing methods and allows the use of readily available low cost materials.

FIG. 1A depicts a projectile made of a poly composite material and having a steel penetrator and a pellet in accordance with some embodiments of the present disclosure. In some embodiments, as shown in FIG. 1A, the projectile 100 has a size and shape of a M80-A1 projectile. In some embodiments, the projectile 100 has an outer diameter of about 7.62 mm. In some embodiments, the projectile 100 has a length of about 30 mm to about 31 mm. The projectile 100 has a front end 102 and a rear end 104. The projectile 100 includes a body 108 made of a cast polymer composite material comprising a thermoset resin and a powdered steel. In some embodiments, a metal core in the form of a penetrator 110 and a pellet 114 is embedded in the body 108.

Figure 1B:
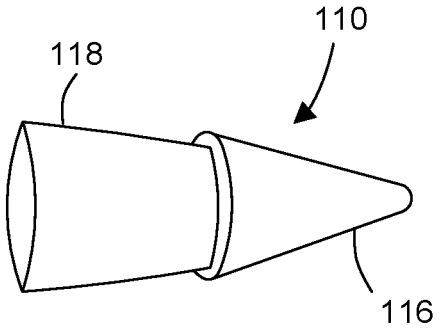
FIG. 1B depicts the steel penetrator of FIG. 1A.
Figure 1C:
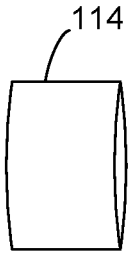
FIG. 1C depicts the pellet of FIG. 1A.

In some embodiments, the penetrator 110 is formed of hardened steel. The penetrator 110, as shown in FIG. 1B, includes a front portion 116 and a rear portion 118. The front portion 116 tapers radially inwards to a tip 112 to define the front end 102 of the projectile 100. In some embodiments, the rear portion 118 is embedded in the body 108 while the front portion 116 is exposed. In some embodiments, the rear portion 118 is embedded in the body 108 and the front portion 116 is coated with a thin layer of the thermoset resin. The projectile 100 includes an annular recess 120 at an interface between the body 108 and the penetrator 110. The pellet 114 is formed of a fragmenting compressed metal. In some embodiments, as shown in FIG. 1C, the pellet 114 has a cylindrical shape. The pellet 114 is disposed adjacent the penetrator 110 on a side of the penetrator 110 closer to the rear end 104 of the projectile 100.

Figure 2A:
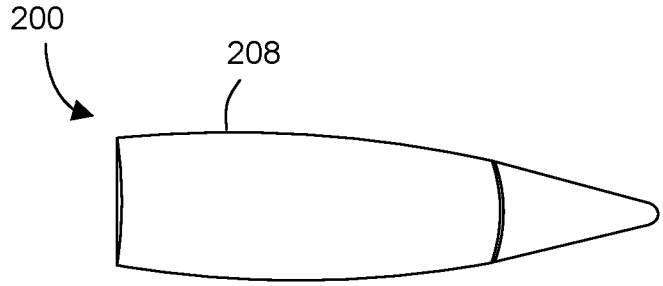
FIG. 2A depicts a projectile made of a polymer composite material in accordance with some embodiments of the present disclosure.
Figure 2B:
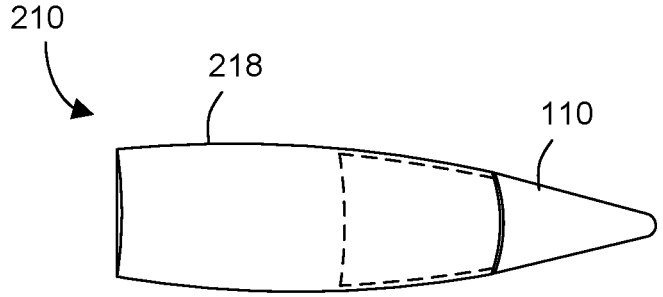
FIG. 2B depicts a projectile made of a polymer composite material and having a steel penetrator in accordance with some embodiments of the present disclosure.
Figure 2C:
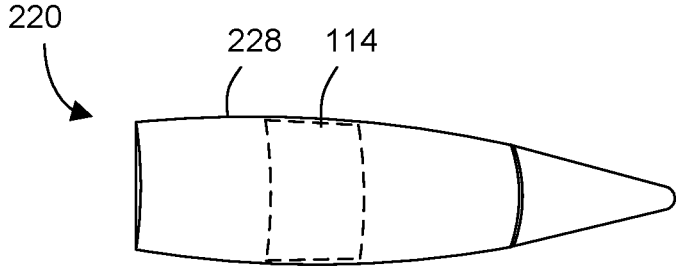
FIG. 2C depicts a projectile made of a polymer composite material and having a pellet in accordance with some embodiments of the present disclosure.
Figure 2D:
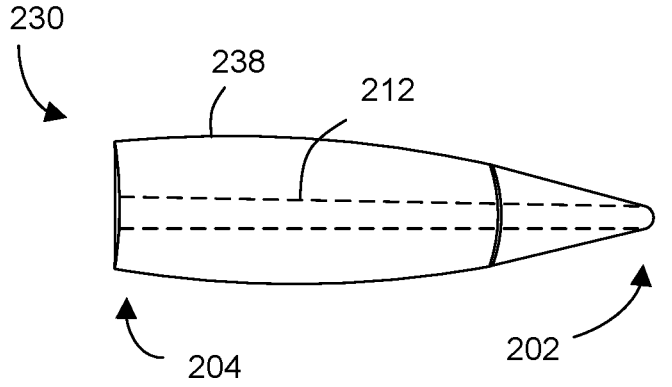
FIG. 2D depicts a projectile made of a polymer composite material and having a stiffing rod in accordance with some embodiments of the present disclosure.

FIGS. 2A-2D depict various configurations of a projectile made of a polymer composite material in accordance with some embodiments of the present disclosure. An overall size and shape of the projectiles shown in FIGS. 2A-2D is similar to the size and shape of the projectile 100 shown in FIG. 1A. FIG. 2A depicts the projectile 200 having a body 208 that is entirely formed of the polymer composite material. FIG. 2B depicts a projectile 210 having a body 218 made of the polymer composite material. The projectile 210 includes the penetrator 110 embedded in the body 218, as described above with respect to FIG. 1A. FIG. 2C depicts a projectile 220 having a body 228 made of the polymer composite material. The projectile 220 includes the pellet 114 embedded in the body 228. FIG. 2D depicts a projectile 230 having a body 238 made of the polymer composite material. The projectile 230 includes a stiffing rod 212 embedded in the body 238. The stiffing rod 212 comprises a metal to provide the projectile 230 with added structural support. In some embodiments, the stiffing rod 212 includes a metal rod that extends from a front end 202 to a rear end 204 of the projectile 230. In some embodiments, the stiffing rod 204 is shaped like a nail and the nail is arranged such that a nail tip is disposed at the front end 202. The flat round head of the nail acts as a solid metal surface defining at least a portion of the rear end 204 of the bullet for increased resistance to damage of the projectile during the high shock and pressure of initial firing.

Figure 3:
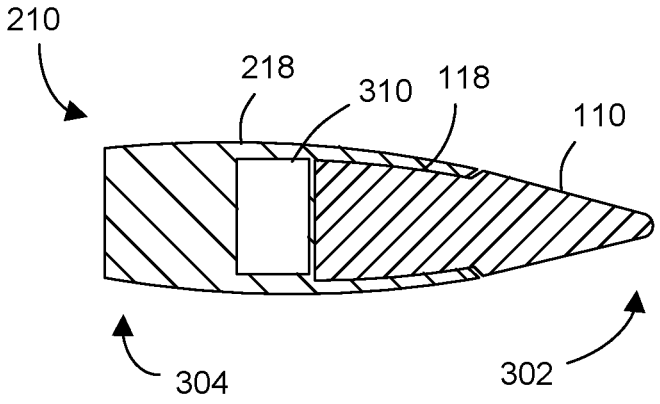
FIG. 3 depicts a cross sectional view of the projectile of FIG. 2B in accordance with some embodiments of the present disclosure.

FIG. 3 depicts a cross sectional view of the projectile 210 of FIG. 2B in accordance with some embodiments of the present disclosure. The penetrator 110 defines a front end 302 of the projectile 210. The projectile 210 includes functional components 310 embedded in the body 218. In some embodiments, the functional components 310 are disposed between the penetrator 110 and a rear end 304 of the projectile 210. In some embodiments, the functional components 310 include an electronic payload. The electronic payload can include batteries, a global positioning system (GPS), light emitting diodes (LEDs), or the like. In some embodiments, the functional components 310 include one or more combustible materials configured to provide tracing a trajectory of the projectile during use. The one or more combustible materials can include strontium peroxide, barium peroxide, potassium perchlorate, magnesium, polytetrafluoroethylene, or the like. The functional components 310 are not limited to use with the projectile 210 of FIG. 2B. The functional components 310 may be embedded in any of the projectiles described herein.

Figure 4:
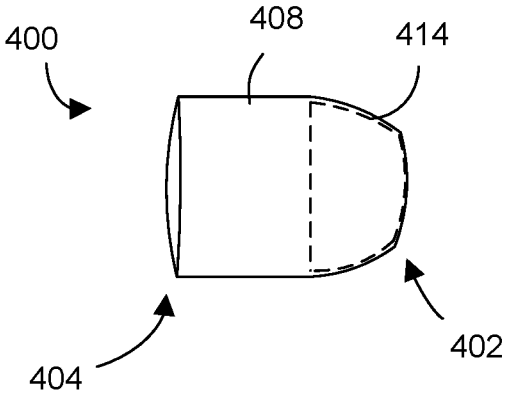
FIG. 4 depicts a projectile made of a polymer composite material and having a pellet in accordance with some embodiments of the present disclosure.

FIG. 4 depicts a projectile 400 having an outer diameter of about 9 mm. The projectile 400 includes a body 408 made of a polymer composite material. The projectile 400 includes a front end 402 and a rear end 404. In some embodiments, the projectile 400 includes a pellet 414 formed of a fragmenting compressed metal. In some embodiments, a front portion of the pellet 414 tapers radially inwards to a tip to define the front end 402 of the projectile 400.

Figure 5A:
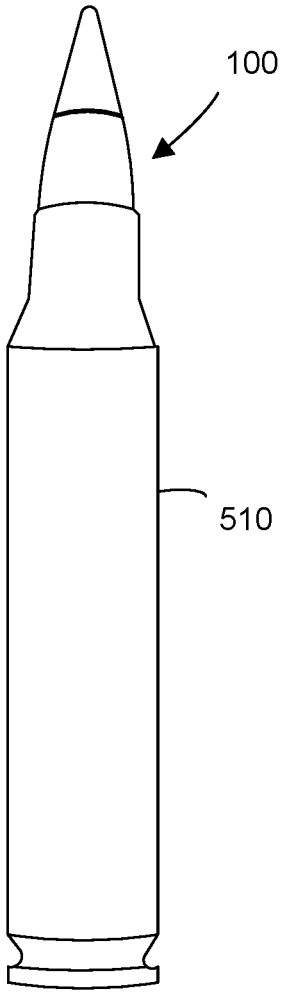
FIG. 5A depicts the projectile of FIGS. 1A, 2A-2D loaded in a casing in accordance with some embodiments of the present disclosure.
Figure 5B:
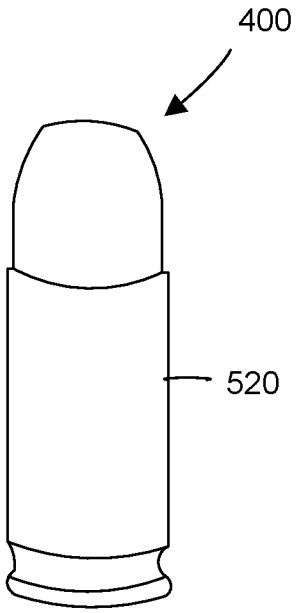
FIG. 5B depicts the projectile of FIG. 4 loaded in a casing in accordance with some embodiments of the present disclosure.

FIG. 5A depicts the projectile 100 (or any projectiles depicted in FIGS. 2A-2D) coupled to a casing assembly 510 near the rear end 104 in accordance with some embodiments of the present disclosure. FIG. 5B depicts the projectile 400 of FIG. 4 coupled to a casing assembly 520 near the rear end 404 in accordance with some embodiments of the present disclosure. The projectiles 100, 400 coupled to their respective casing assemblies 510, 520 are configured to be loaded into a barrel of a firearm. The casings assemblies 510, 520 include any suitable gunpowder that can ignite in the barrel of the firearm to propel the projectile 100, 400 out of the firearm. In some embodiments, the casing assembly 510 is 300 AAC brass for use with a 300 AAC rifle.

Figure 6:
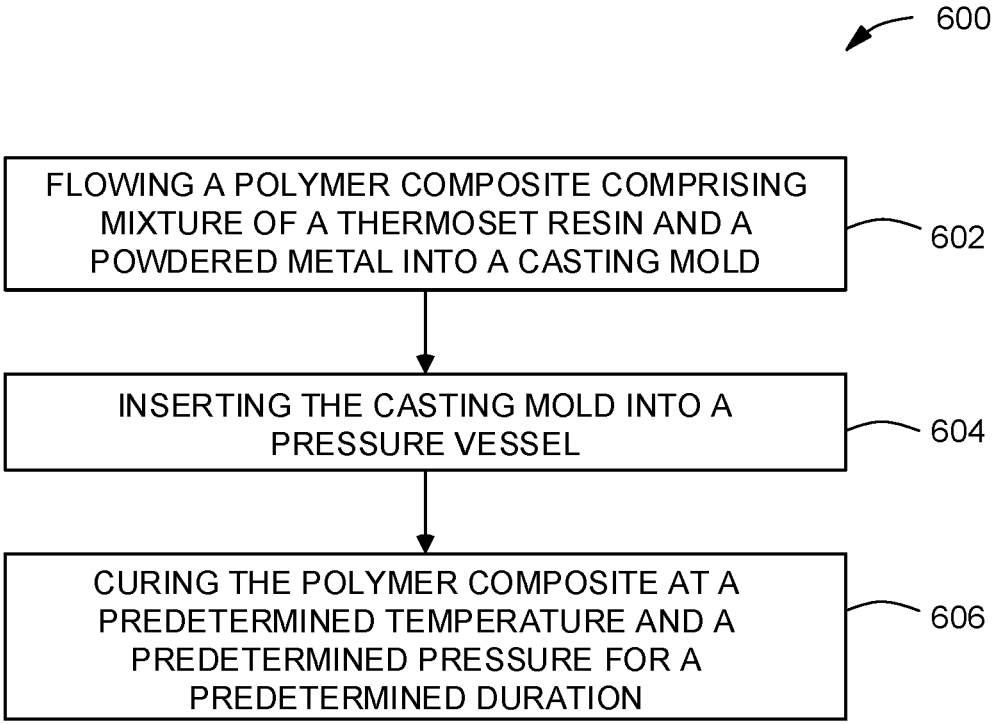
FIG. 6 is a flow chart of a method of manufacturing a projectile in accordance with some embodiments of the present disclosure.

FIG. 6 is a flow chart of a method 600 of manufacturing a projectile in accordance with some embodiments of the present disclosure. The method 600 starts at 602 by flowing a polymer composite comprising mixture of a thermoset resin and a powdered metal into a casting mold configured to form a predetermined caliber projectile. For example, the predetermined caliber can be about 5.56 mm, about 7.62 mm, or about 9.0 mm. In some embodiments, a metal core is placed into the casting mold prior to flowing the polymer composite into the mold. In some embodiments, prior to placing the metal core into the casting mold, the casting mold is partially filled with a small amount of the thermoset resin. The small amount of thermoset resin can form a thin coat of clear material over a portion of the metal core. In some embodiments, excess thermoset resin may be removed from the casting mold after placing the metal core into the casting mold. The excess thermoset resin may be removed, for example, with a pipette. In some embodiments, an electronic payload or one or more combustible materials configured to provide tracing a projectory of the projectile during use are placed into the casting mold prior to flowing the polymer composite into the casting mold.

At 604, the casting mold is inserted into a pressure vessel. Once the casting mold is inserted, a lid is placed over the pressure vessel. At 606, the polymer composite is cured at a predetermined temperature and a predetermined pressure for a predetermined duration. In some embodiments, the predetermined temperature is about 80 degrees Celsius. In some embodiments, the predetermined pressure is about 60 pounds per square inch. In some embodiments, the predetermined duration is about 3 hours to about 5 hours. In some embodiments, the predetermined duration is 24 hours or less.

The casting methods described herein advantageously allows more fragile electronics such as LEDs or microelectronics or other materials that would not survive metal forming or thermal plastic extrusion.

While the foregoing is directed to embodiments of the present disclosure, other and further embodiments of the disclosure may be devised without departing from the basic scope thereof.

The invention claimed is:

1. A projectile, comprising:

a body made of a cast polymer composite material comprising a thermoset resin and a powdered steel further comprising a metal core embedded in the body wherein said metal core includes at least one of a steel penetrator, a pellet formed of a fragmenting compressed metal, or a stiffing rod and wherein the thermoset resin comprises a two part thermosetting polyurethane resin or an epoxy resin and, wherein an outer diameter of the projectile is about 7.0 mm to about 9.0 mm.

* * * * *